US005318237A

United States Patent [19]

Lotto et al.

[11] Patent Number: 5,318,237

[45] Date of Patent: Jun. 7, 1994

[54] AIR HORN FOR WEB WINDING MACHINE

[75] Inventors: Ronald L. Lotto, Bonduel, Wis.; Eric DeSmedt, Opwijk; Julien Antoons, Gooik, both of Belgium

[73] Assignee: FMC Corporation, Chicago, Ill.

[21] Appl. No.: 958,214

[22] Filed: Oct. 8, 1992

[51] Int. Cl.[5] ..... B65H 18/08

[52] U.S. Cl. ..... 242/67.2; 242/56.8

[58] Field of Search ..... 242/56 A, 56 R, 67.1 R, 242/67.2, 195

[56] References Cited

U.S. PATENT DOCUMENTS

| | | | |
|---|---|---|---|
| 3,471,097 | 10/1969 | Phelps | 242/56 R |
| 3,734,423 | 5/1973 | Kataoka | 242/56 A |
| 3,908,924 | 9/1975 | Schulze | 242/56 A X |
| 4,339,089 | 7/1982 | Dobbins | 242/56 A X |
| 4,456,190 | 6/1984 | Karttunen et al. | 242/56 R |
| 4,630,783 | 12/1986 | Mulfarth | 242/56 |
| 4,667,890 | 5/1987 | Gietman, Jr. | 242/55 |
| 4,711,404 | 12/1987 | Falk | 242/56 R |
| 4,715,552 | 12/1987 | Matsumoto | 242/56 |
| 5,022,597 | 6/1991 | Morizzo | 242/56 R |

FOREIGN PATENT DOCUMENTS

| | | |
|---|---|---|
| 238030 | 10/1959 | Australia . |
| 0077400 | 4/1982 | European Pat. Off. . |
| 49-41542 | 11/1974 | Japan . |
| 867086 | 5/1961 | United Kingdom . |
| 1227554 | 6/1968 | United Kingdom . |
| 1398536 | 8/1972 | United Kingdom . |
| 2085413 | 4/1982 | United Kingdom . |
| 2096973 | 10/1982 | United Kingdom . |
| 2101977 | 1/1983 | United Kingdom . |

*Primary Examiner*—Daniel P. Stodola
*Assistant Examiner*—Eileen A. Dunn
*Attorney, Agent, or Firm*—Henry C. Query, Jr.; Richard B. Megley

[57] ABSTRACT

In combination with a web winding machine comprising a spindle for winding up a web of material having a leading edge and an apparatus for transporting the web to the spindle, an air horn proximate the spindle having an arm, a first air tube connected to a forward portion of the arm and a second air tube connected to the arm rearward of the first air tube, wherein the arm comprises an inner surface generally conforming to the spindle and a plurality of apertures extending between each of the first and second air tubes and the inner surface; and wherein the first and second air tubes are connected with a source of air, whereby the air is directed through the apertures to force the leading edge up off of the conveyor belt and against the spindle.

5 Claims, 2 Drawing Sheets

AIR HORN FOR WEB WINDING MACHINE

FIELD OF THE INVENTION

This invention relates to a device for use in a machine for rolling up a web of material, such as plastic bags. More particularly, this invention pertains to a device which projects a blast of air toward the leading edge of the web of material as it advances toward a spindle to assist in starting the web onto the spindle at the beginning of the winding process.

BACKGROUND OF THE INVENTION

Web winding machines function to wind or roll up webs or films of material, such as a continuous length of plastic bags or a series of separate, interleaved or overlapping plastic bags. As the web advances on a conveyor belt toward a winder, its leading edge must be taken up upon a spindle to initiate the winding process. In one embodiment of a winding machine, multiple spindles are mounted on a rotatable turret. As the web is being wound upon one spindle, a second spindle stands by to take over the winding of the web once the amount of web material wound upon the first spindle reaches a predetermined maximum. Typically, when this happens, a web separator device causes the web to separate as it advances toward the winder, thus creating a leading edge in the new length of material to be wound. This leading edge must then be directed around the second spindle so that a new roll can be started.

Air horns are used to force the leading edge of the web onto the spindle upon which it will be wound. Existing air horns employ a single air tube to direct a blast of air between the conveyor belt and the spindle to lift the leading edge and direct it over the spindle. When attaching the leading edge to the spindle, the faster and more accurately the web can be attached, the straighter the edge of the roll of material will be. A fast and accurate attachment of the leading edge to the spindle will thus avoid or minimize the undesirable effect of telescoping of the roll.

Also, after the web has been started on the spindle, one embodiment of a winding machine will pivot the air horn away from the spindle and the turret will shift the spindle to a final wind position. As the web advances toward this spindle, it may have a tendency to lift off of the conveyor belt. This is especially a problem with interleaved bags; since the ends of the bags are not restrained, the bags may tend to separate before reaching the spindle, thus disrupting the final wind process.

SUMMARY OF THE INVENTION

Therefore, it is an object of the present invention to provide an air horn which can quickly and accurately attach the leading edge of a web onto the spindle upon which it will be wound. It is another object of the present invention to provide an air horn that can hold the web against the conveyor belt as it advances to the spindle so that the web will not lift or separate.

According to the present invention, these and other objects and advantages are achieved by providing an air horn having an arcuate arm conforming to the spindle and two air tubes: a first air tube for directing a blast of air between the spindle and the conveyor belt to lift the leading edge of the web up and over the spindle, and a second air tube for directing a blast of air to force the leading edge around and against the spindle. Also, the rear portion of the arm is designed to curve in toward the nip between the conveyor belt and the spindle, thus forcing the leading edge into the nip. The air tubes and curved rear portion result in a quick and uniform attachment of the leading edge to the spindle.

In addition, the air horn of the present invention comprises a third air tube mounted to a tail portion of the arm. When the air horn is retracted to allow the turret to shift the spindle to the final wind position, the third air tube directs a blast of air against the web travelling along on the conveyor belt to prevent the web from lifting or separating.

These and other objects and advantages of the present invention will be made apparent from the following detailed description, with reference to the accompanying drawings.

DETAILED DESCRIPTION OF THE PREFERRED EMBODIMENT

Figure 1:
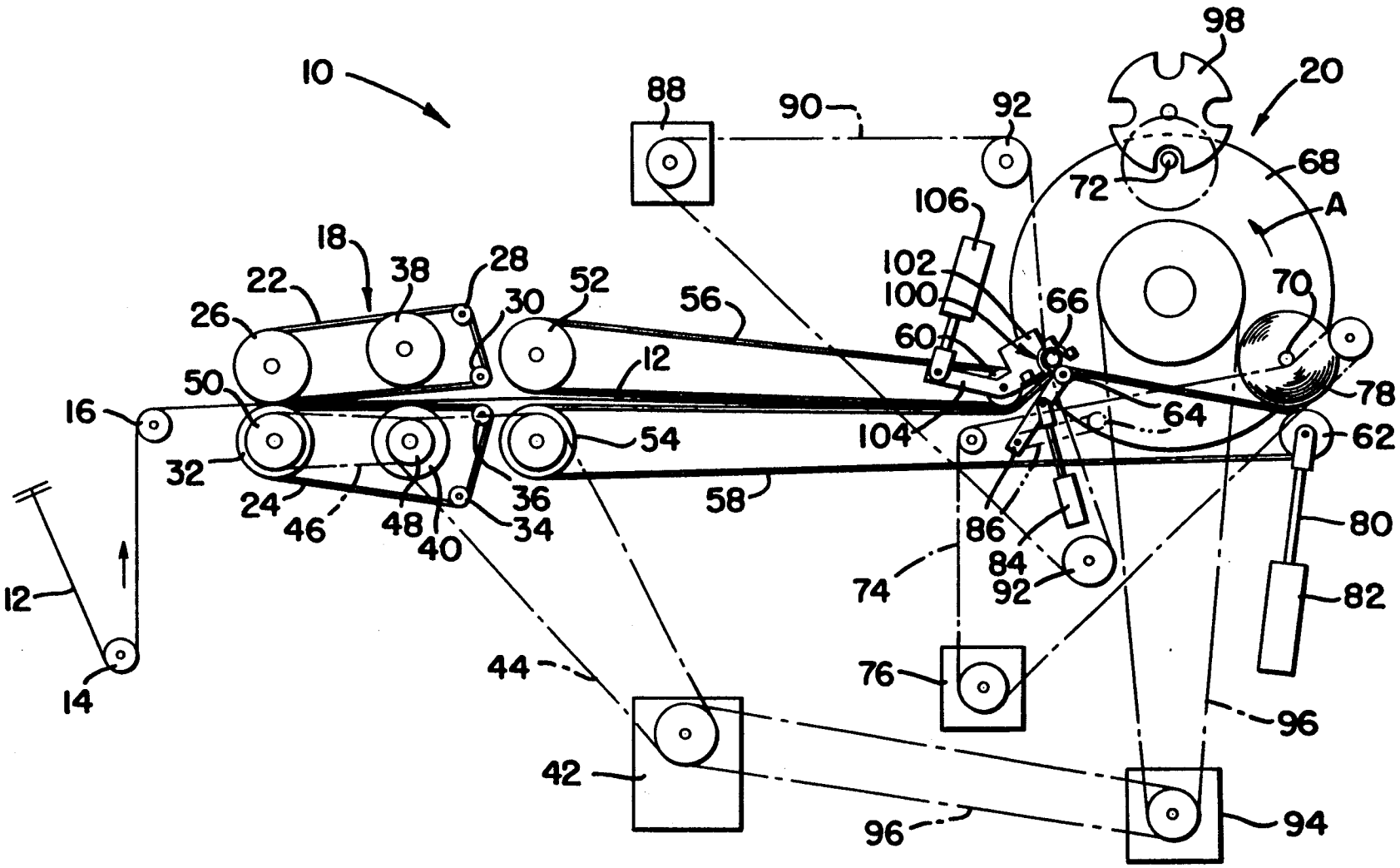
FIG. 1 is a schematic representation of a web winding machine incorporating the air horn of the present invention.

The air horn of the present invention is described with reference to a web winding machine in which it is employed. Referring to FIG. 1, the web winding machine, indicated generally by reference numeral 10, operates to roll up a web of material 12, which can be, for example, a continuous web of plastic bags separated by perforations or a series of overlapping or interleaved plastic bags. During operation of winding machine 10, web 12 passes around a guide roller 14 and a compensator roller 16 before following a generally horizontal path through a web separator section 18 to a turret winder 20. After passing over compensator roller 16, web 12 travels between rollers 26 and 32 and guide cords 22 and 24, which are entrained around rollers 26, 28 and 30 and rollers 32, 34 and 36, respectively.

Rollers 38 and 40, located between rollers 26, 28 and 30 and rollers 32, 34 and 36, respectively, operate to speed up web 12 to separate the bags when a sufficient amount of web material has been rolled up on turret winder 20. Rollers 32 and 40 are driven by drive member 42 through drive belts 44 and 46. Belt 44 engages drive member 42 and a pulley 48 connected to roller 40, and belt 46 engages pulley 48 and a second pulley 50 connected to roller 32. Pulley 48 is selected to have a diameter smaller than the diameter of pulley 50. Therefore, since rollers 32 and 40 have approximately the same diameters, roller 40 will rotate faster than roller 32. Roller 38 is driven by roller 40 through means not depicted. When it is desired to separate web 12 at an appropriate point, roller 38 is brought into contact with roller 40. Since rollers 38 and 40 are rotating faster than rollers 26 and 32, the web material caught between rollers 38 and 40 will pull away from the web material caught between rollers 26 and 32 and web 12 will separate, thereby creating a leading edge in the second or following web section. Guide cords 22 and 24 will not interfere with this operation since rollers 38 and 40 are provided with annular grooves into which they are allowed to retract when rollers 38 and 40 are brought together.

After passing through separator section 18, web 12 passes between feed rollers 52 and 54. Web 12 is guided along toward turret winder 20 by conveyor cords 56 and a conveyor belt 58, which are entrained around rollers 52 and 60 and rollers 54 and 62, respectively. After passing under roller 60, conveyor belt 58 travels over a kick roller 64, which is deflectable from a first position (depicted in phantom in FIG. 1) to a second position (depicted in FIG. 1) to direct conveyor belt 58 and, therefore, web 12 toward a first spindle 66 on turret winder 20, as will hereafter be described.

Referring still to FIG. 1, turret winder 20 comprises a turret disk 68 which, in the embodiment depicted, rotationally supports three spindles and is rotatable to index the spindles between each of three indexed positions: a transfer position, a final wind position and a push off position. The spindles are defined by their respective indexed positions on disk 68. Thus, when disk 68 is in the position shown in FIG. 1, the first spindle 66 is in the transfer position and is defined as the transfer spindle, a second spindle 70 is in the final wind position and is defined as the final wind spindle, and a third spindle 72 is in the push off position and is defined as the push off spindle.

During the operation of web winding machine 10, web 12 is advanced toward transfer spindle 66, upon which the web is initially wound, as will hereafter be described. When an initial amount of web 12 is rolled up upon transfer spindle 66, turret winder 20 rotates disk 68 in the direction of arrow A, as will be described, to index spindle 66 to the final wind position, whereupon spindle 66 becomes the final wind spindle 70. This same indexing operation indexes former spindle 70 to the push off position and former spindle 72 to the transfer position.

Final wind spindle 70 is driven by a drive belt 74 which, in turn, is driven by a drive member 76. Final wind spindle 70 is driven at a rate such that the speed at the surface of the roll 78 of web material corresponds to the feed speed of web 12. While web 12 is being wound upon final wind spindle 70, roller 62, which is mounted on the end of a piston rod 80 of a piston and cylinder unit 82, is urged against conveyor belt 58, causing conveyor belt 58 to remain in close contact with roll 78.

Once a predetermined number of bags or material length is wound upon final wind spindle 70, a switch device (not shown), activates web separator 18, which operates to separate web 12 in the manner previously described. That same switch activates a piston 84, which is pivotally connected to a kick arm 86 supporting kick roller 64, to deflect conveyor belt 58 toward transfer spindle 66 and thereby bring the leading edge of the following separated web into contact with transfer spindle 66. Transfer spindle 66 is driven by means of a drive member 88 through a drive belt 90, which is guided against the drive pulley of transfer spindle 66 by means of guide rollers 92.

Once a predetermined minimum amount of web 12 is wound upon transfer spindle 66, a switch device (not shown) activates a clutch means 94, which connects motor 42 to turret winder 20 via belts 96 to rotate disk 68 in the direction of arrow A and thereby bring transfer spindle 66 to the final wind position, final wind spindle 70 to the push off position, and push off spindle 72 to the transfer position. As disk 68 rotates, transfer spindle 66 pushes kick roll 64 down to its first position (shown in phantom in FIG. 1). During the indexing of transfer spindle 66 to the final wind position, the drive of spindle 66 is transferred from belt 90 to belt 74. After final wind spindle 70 is indexed to the push off position, roll 78 is pushed off with the aid of a pusher plate 98, in a manner well known in the art.

The initial winding of the leading edge of web 12 upon transfer spindle 66 is aided by means of the air horn of the present invention, indicated generally by reference numeral 100. Air horn 100 is positioned generally over transfer spindle 66 and is supported on a mount 102 connected to a lever 104, which is pivotally connected to the same spindle as roller 60. The distal end of lever 104 is connected to a piston 106 which, when a predetermined minimum amount of web 12 is wound upon transfer spindle 66, is operable to force lever 104 downward to thereby retract air horn 100 so that it will not interfere with the indexing of transfer spindle 66 to the final wind position.

Figure 2:
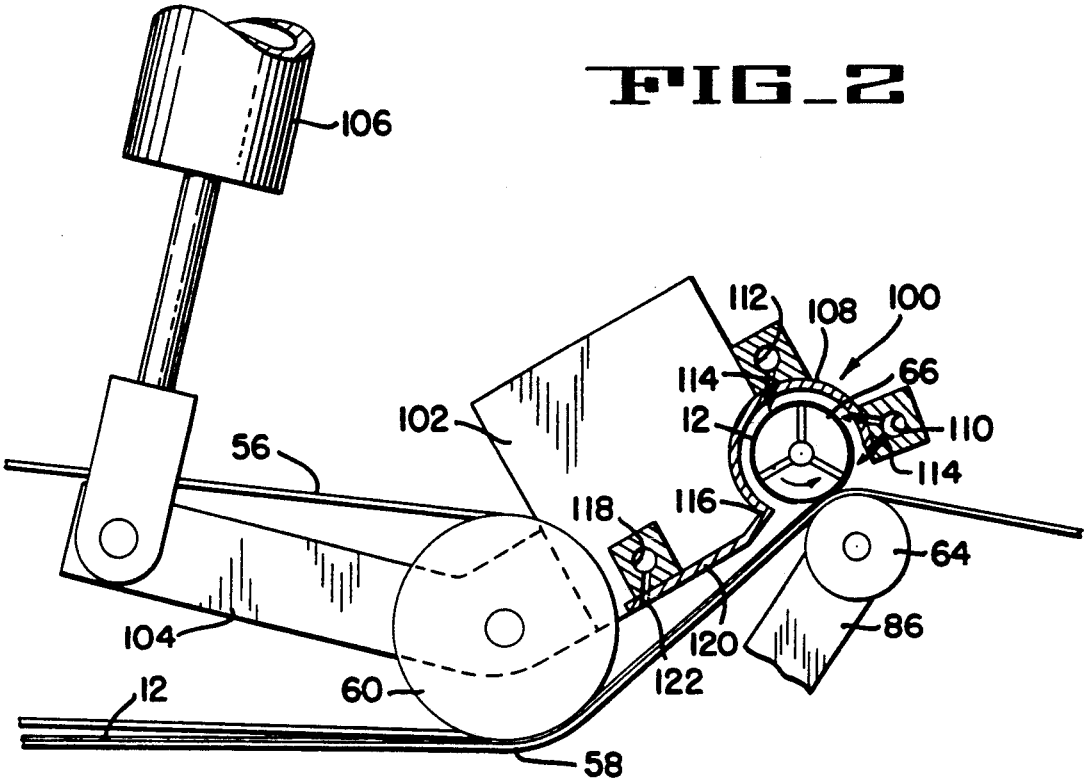
FIG. 2 is an enlarged schematic representation of the air horn of the present invention.

Referring to FIG. 2, air horn 100 comprises an arm 108 having a concave inner surface which conforms generally to transfer spindle 66. Air horn 100 further comprises two air supply means, such as air tubes 110 and 112, mounted to arm 108. Tube 110 is preferably mounted at the forward end of arm 108, and tube 112 is preferably mounted at the middle or top of arm 108 behind tube 110. Tubes 110 and 112 are connected to a source of compressed air 124 (FIG. 3) and communicate with the inner surface of arm 108 by way of a series of apertures 114. The diameter of apertures 114 is selected to be large enough to allow sufficient air through to control heavy gauge webs. Tube 110 preferably comprises two sets of apertures 114: one which directs a blast of air between conveyor belt 58 and transfer spindle 66, and another which directs a blast of air around transfer spindle 66. In addition, tube 110 comprises a generally rectangular cross section, and one set of apertures 114 is located at a corner of tube 110 adjacent the nip between spindle 66 and conveyor belt 58 to more efficiently direct air under the leading edge of web 12. In operation, when the leading edge of web 12 approaches transfer spindle 66, piston 106 raises lever 104 to bring air horn 100 over transfer spindle 66. At approximately the same time, compressed air is directed through tubes 110 and 112, out apertures 114 and toward transfer spindle 66. The force of the compressed air lifts the leading edge of web 12 and directs it up, around and against the rotating transfer spindle 66. The placement of tube 112 is selected to ensure that the compressed air forces web 12 against a large portion of the circumference of transfer spindle 66. Furthermore, the rear portion 116 of arm 108 curves inward toward the nip between transfer spindle 66 and conveyor belt 58. Rear portion 116 thus directs the lead edge of web 12 into the nip to ensure that web 12 is uniformly attached to transfer spindle 66. Preferably, air horn 100 extends substantially the width of web 12 and the compressed air emitting from apertures 114 contacts web 12 over substantially its entire width to ensure that web 12 is uniformly rolled up upon transfer spindle 66 and undesirable telescoping of roll 78 is avoided. Also, the initial winding of web 12 upon transfer spindle 66 may be aided by means of a vacuum connected to an axial bore in transfer spindle 66 and communicating with the outer surface of transfer spindle 66 through a series of transverse apertures.

Figure 3:
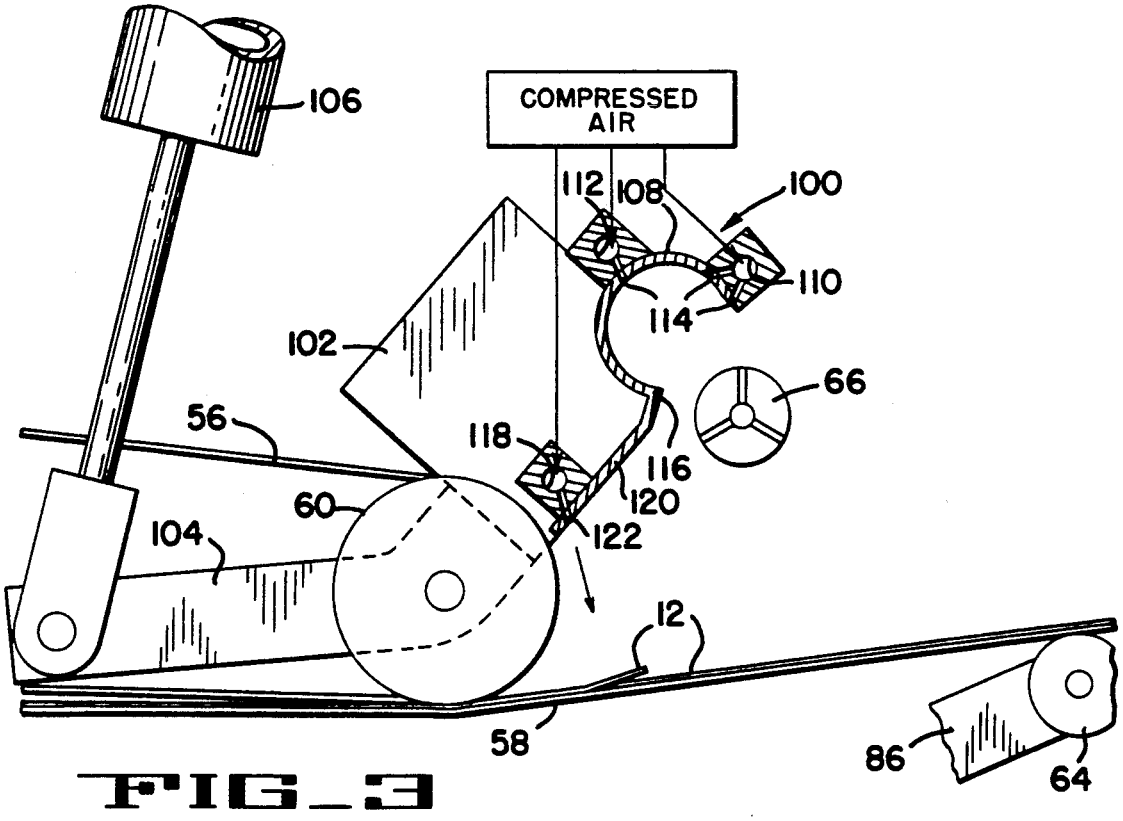
FIG. 3 is an enlarged schematic representation of the air horn of the present invention in the retracted position.

While web 12 is being wound upon final wind spindle 70, air horn 100 is in its retracted position, as shown in FIG. 3. After web 12 passes roller 60 on its way to final wind spindle 70, there are no belts or guide cords to hold web 12 down against conveyor belt 58. Therefore, web 12 may have a tendency to billow up or, if web 12 comprises a series of individual interleaved bags, separate. To alleviate this problem, air horn 12 preferably comprises an additional air supply means, such as tube 118, connected to a tail portion 120 of arm 108. Tube 118 is connected to the source of compressed air 124 and communicates with the underside of air horn 100 through a series of apertures 122. When air horn 100 is in its raised or retracted position, a limit switch (not shown) on either mount 102 or lever 104 operates to activate the source of compressed air to direct the compressed air out apertures 122 and downward toward web 12 to thereby hold web 12 against conveyor belt 58.

It should be recognized that, while the present invention has been described in relation to the preferred embodiment thereof, those skilled in the art may develop a wide variation of structural details without departing from the principles of the invention. Therefore, the appended claims are to be construed to cover all equivalents falling within the true scope and spirit of the invention.

What is claimed is:

1. In combination with a web winding machine comprising a spindle for winding up a web of material having a leading edge and conveying means for transporting the web to the spindle, the improvement comprising:

an air horn proximate the spindle, the air horn having an arm, first air supply means connected to a forward portion of the arm and second air supply means connected to the arm rearward of the first air supply means;

the arm comprising an inner surface generally conforming to the spindle and a plurality of apertures extending between each of the first and second air supply means and the inner surface;

wherein the first and second air supply means are connected with a source of air;

whereby the air is directed through the apertures to urge the leading edge proximate the spindle.

2. The combination of claim 1, wherein the air horn is retractable from its position proximate the spindle;

the arm further comprising a tail portion defining an underside of the arm;

the air horn further comprising third air supply means connected to the tail portion;

the tail portion comprising a apertures extending between the third air supply means and the underside; and wherein the third air supply means is connected to the source of air, which is activated when the air horn is retracted from the position proximate the spindle;

whereby the source of air is directed through the apertures to hold the web against the conveying means.

3. The combination of claim 1, wherein the arm comprises an arcuate rear portion extending toward a nip point between the spindle and the conveying means.

4. The combination of claim 1, wherein the first air supply means comprises a generally rectangular cross section and the arm comprises at least one of the plurality of apertures extending through a corner of the first air supply means adjacent a nip between the spindle and the conveying means.

5. A method for directing the leading edge of a moving web of multi-sided material onto a rotating spindle, comprising the steps of:

directing the leading edge into contact with the rotating spindle;

directing a first flow of gas against a side of the leading edge not in contact with the spindle; and directing a second flow of gas toward the spindle at an angle non-perpendicular to the spindle.

* * * * *